US006996865B2

(12) United States Patent
Sabin

(10) Patent No.: US 6,996,865 B2
(45) Date of Patent: Feb. 14, 2006

(54) MATTRESS STRUCTURE

(76) Inventor: Jeffrey M. Sabin, 424 Burt Cir., Lewiston, NY (US) 14092

( * ) Notice: Subject to any disclaimer, the term of this patent is extended or adjusted under 35 U.S.C. 154(b) by 0 days.

(21) Appl. No.: 10/850,606

(22) Filed: May 20, 2004

(65) Prior Publication Data

US 2004/0231057 A1 Nov. 25, 2004

Related U.S. Application Data

(60) Provisional application No. 60/472,936, filed on May 23, 2003, provisional application No. 60/474,498, filed on May 30, 2003.

(51) Int. Cl.
*A47C 23/04* (2006.01)
*A47C 23/05* (2006.01)
*F16F 3/04* (2006.01)

(52) U.S. Cl. ..... 5/716; 5/263; 267/91

(58) Field of Classification Search ..... 5/716, 5/719, 729, 246, 263, 401, 697, 936; 267/91, 267/94, 103
See application file for complete search history.

(56) References Cited

U.S. PATENT DOCUMENTS 52,585 A * 2/1866 McClanathan ..... 5/243
66,849 A * 7/1867 Johnson ..... 5/258
106,069 A * 8/1870 Lord ..... 5/258
958,356 A * 5/1910 Bode ..... 297/284.3
986,183 A * 3/1911 Leahan ..... 5/258
1,248,671 A * 12/1917 Kelly ..... 267/131
1,284,384 A 11/1918 Lewis
1,465,766 A 8/1923 Krakauer
1,475,010 A * 11/1923 Garbutt ..... 5/258
2,503,333 A * 4/1950 Gyles ..... 5/246
2,532,425 A * 12/1950 Schenker ..... 5/401
3,031,690 A * 5/1962 Ramsay ..... 5/401
3,252,170 A * 5/1966 Frye ..... 5/697
3,633,228 A 1/1972 Zysman
3,656,190 A * 4/1972 Regan et al. ..... 5/613
3,999,234 A * 12/1976 Regan ..... 5/716
4,234,984 A 11/1980 Stumpf
4,451,946 A 6/1984 Stumpf
4,986,518 A 1/1991 Stumpf
5,105,488 A 4/1992 Hutchinson et al.
5,127,635 A 7/1992 Long et al.

(Continued)

FOREIGN PATENT DOCUMENTS

GB 2178307 A * 2/1987

*Primary Examiner*—Robert G. Santos
(74) *Attorney, Agent, or Firm*—Hodgson Russ LLP

(57) ABSTRACT

A mattress comprises a support plate having a plurality of mounting holes, a plurality of independent spring assemblies individually mounted to the support plate, and a cover enclosing the support plate and the plurality of spring assemblies. Each of the spring assemblies includes a tubular mounting member fixed to the support plate preferably by snap-fit through a mounting hole in the support plate, a sliding cap axially movable relative to the mounting member, and a spring acting between the mounting member and the sliding cap, wherein the spring is axially compressible when the sliding cap is forced in an axial direction toward the support plate. A spacer of chosen length can be provided to set preload on the spring. In a "flippable" embodiment, the mounting member includes a mid-portion snap-fitted to the support plate and upper and lower portions each having a sliding cap associated therewith, wherein the spring acts between the two sliding caps. In yet another embodiment, the sliding cap is replaced by a bellows attached to the mounting member.

11 Claims, 10 Drawing Sheets

U.S. PATENT DOCUMENTS 5,332,202 A * 7/1994 Wagner et al. ..... 267/82
5,414,874 A * 5/1995 Wagner et al. ..... 5/263
5,435,023 A * 7/1995 Wagner et al. ..... 5/270
5,469,590 A 11/1995 Simon
5,868,383 A 2/1999 Codos
6,003,178 A * 12/1999 Montoni ..... 5/690
6,173,464 B1 1/2001 McCune et al.
6,260,223 B1 7/2001 Mossbeck et al.
6,487,738 B1 * 12/2002 Graebe ..... 5/719
6,742,202 B1 * 6/2004 Jones ..... 5/263
2004/0231057 A1 * 11/2004 Sabin ..... 5/716

* cited by examiner

MATTRESS STRUCTURE

CROSS REFERENCE TO RELATED APPLICATIONS

This application claims benefit of U.S. Provisional Patent Application No. 60/472,936 filed May 23, 2003 and U.S. Provisional Patent Application No. 60/474,498 filed May 30, 2003, and the disclosures of these applications are incorporated herein by reference.

FIELD OF THE INVENTION

The invention relates to the field of mattresses.

BACKGROUND OF THE INVENTION

Typically, mattresses found in the marketplace include a series of coiled springs that are supported by cross members to keep the spring ends from bucking off axis or moving horizontally, and to achieve a certain amount of flatness. Cross members typically have small coils that are looped through the ends of the main coiled springs. If the ends are not supported by the cross members, the diameter of the spring must be large enough to resist instability (moving horizontally) or bucking.

A main problem with existing mattresses is that when the spring quantities are increased, cross members are added due to the instability of the spring ends. The cross members effectively reduce the independency of the springs. A load on one spring location will transmit that load to adjacent spring locations due the cross members. Also, the load rate as the spring is being compressed increases exponentially. Due to this effect, the body will experience pressure points and nonconformance to the body.

In existing mattresses that contain no cross members, the spring diameter will generally be large to prevent the spring from buckling off axis, and as a result the number of springs in the mattress must be reduced for space reasons. Consequently, the spring rate of the springs will be increased to compensate for the reduced number of springs in the mattress, and the body will experience pressure points and nonconformance to the body.

Another problem with existing mattresses is that the spring coils are exposed so that the mattress requires more insulation between the spring coils and the body.

Other prior art mattress designs include solid layers of latex foam (no spring design) and/or viscoelastic (memory) foam in combination with other foam. A main problem with these designs is related to the horizontal tension strength and shear strength of the material. The adjacent foam is affected by the nearby load from the body and does not act independently, and this gives rise to pressure points. Another problem with such designs is that the spring rate is generally constant throughout the mattress surface. Therefore, the spring rate can not be varied in different sections of a mattress. Another problem associated with viscoelastic (memory) foam is that it is slow to respond to body movement, as a person turns or moves in bed, and this can limit or make movement more difficult once the foam forms a set.

SUMMARY OF THE INVENTION

It is therefore an object of the present invention to provide a mattress having improved pressure distribution with varied support characteristics at targeted areas.

It is another object of the present invention to provide a mattress wherein each spring responds independently and at a constant load rate.

It is another object of the present invention to provide a mattress that conforms well to the body to attain a buoyant effect.

It is a further object of the present invention to provide a mattress wherein the springs are unexposed to the cover padding.

It is yet another object of the present invention to provide a mattress that achieves the above-objects while being inexpensive to manufacture and customize.

In furtherance of these objects, a mattress of the present invention generally comprises a support plate having a plurality of mounting holes, a plurality of independent spring assemblies individually mounted to the support plate, and a cover enclosing the support plate and the plurality of spring assemblies. Each of the plurality of spring assemblies includes a tubular mounting member fixed to the support plate preferably by snap-fit of a catch plug through a mounting hole in the support plate, a sliding cap axially movable relative to the mounting member, and a spring acting between the mounting member and the sliding cap, wherein the spring is axially compressible when the sliding cap is forced in an axial direction toward the support plate. A spacer of chosen length can be provided to set preload on the spring. The mounting member, sliding cap, and spacer may be manufactured from plastic by injection molding.

In a "flippable" embodiment, the mounting member includes a mid-portion snap-fitted to the support plate and upper and lower portions each having a sliding cap associated therewith, and the spring acts between the two sliding caps.

In still another alternative embodiment, the sliding cap is replaced by a bellows attached to the mounting member.

BRIEF DESCRIPTION OF THE DRAWINGS

The nature and mode of operation of the present invention will now be more fully described in the following detailed description taken with the accompanying drawing figures, in which.

DETAILED DESCRIPTION OF THE INVENTION

Figure 1:
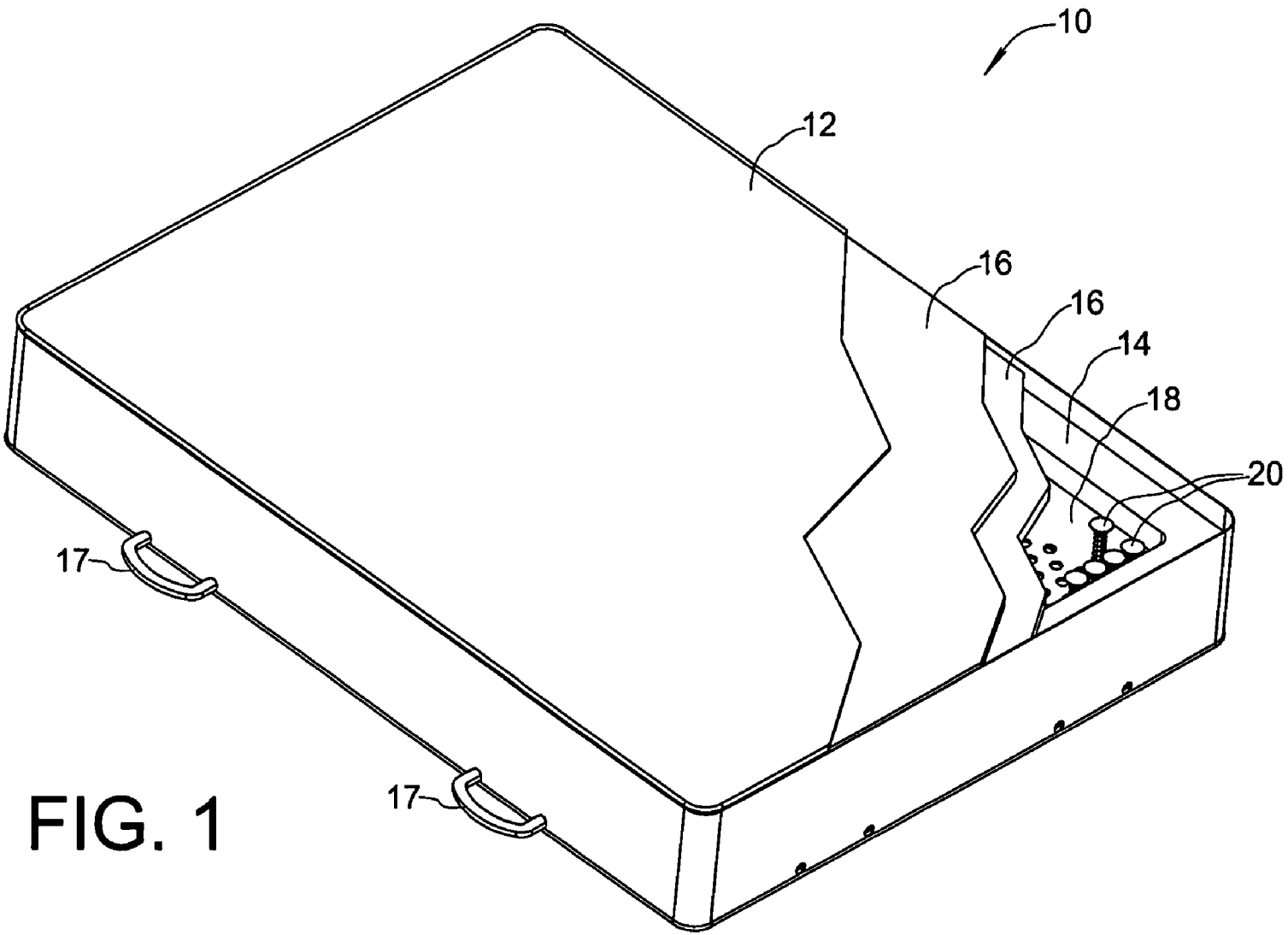
FIG. 1 is a partially cut away perspective view of a mattress embodying the present invention.
Figure 2:
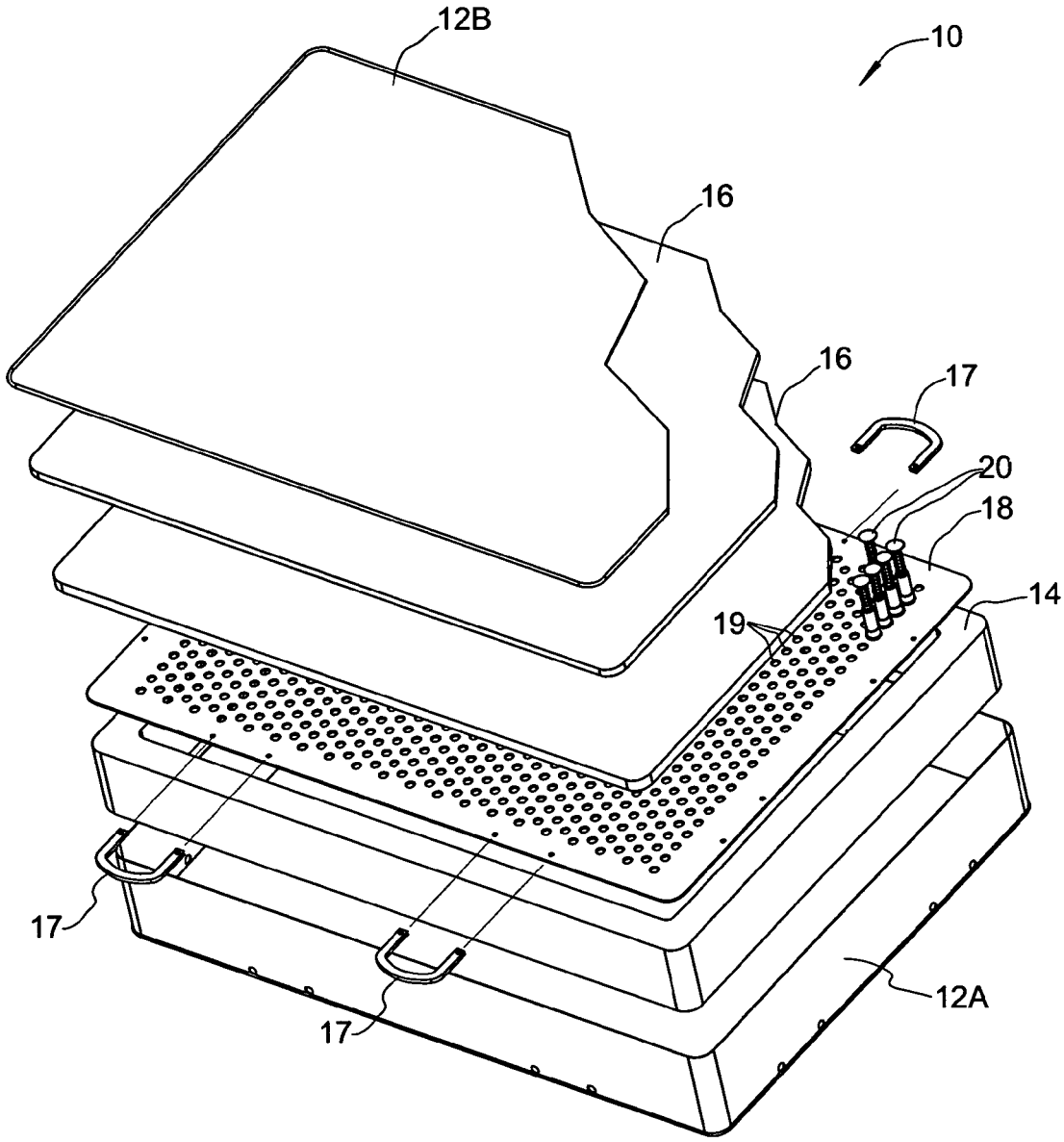
FIG. 2 is an exploded view of the mattress shown in FIG. 1.
Figure 3:
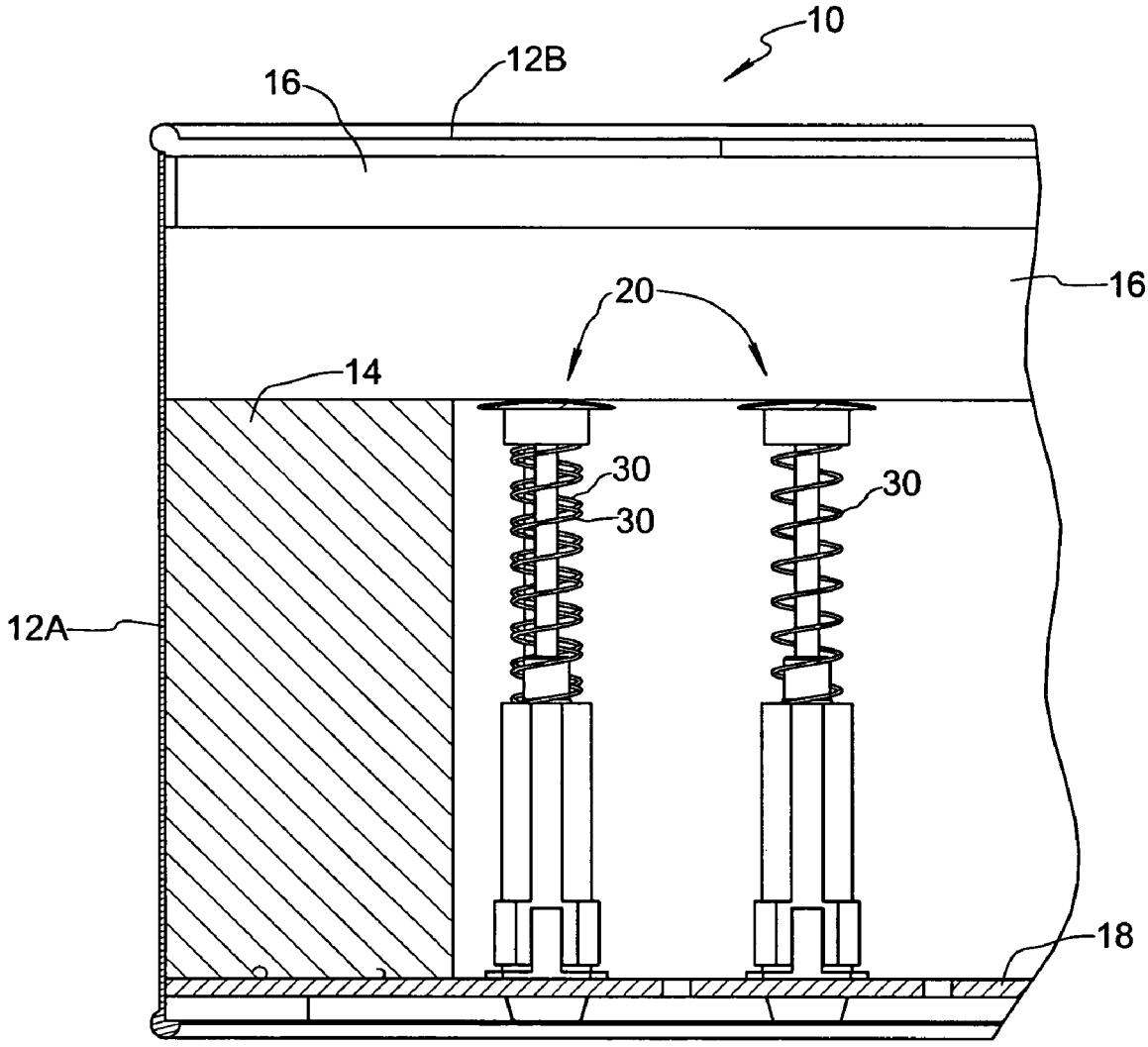
FIG. 3 is a cross-sectional view showing a portion of the mattress shown in FIG. 1.

FIGS. 1–3 show a mattress 10 embodying the present invention. Mattress 10 generally comprises an outer cover 12 that encloses a rectangular perimeter pad 14, a plurality of padding layers 16 overtop the perimeter pad, a support plate 18 beneath the perimeter pad, and a plurality of vertical spring assemblies 20 mounted on the support plate 18 within the interior of the perimeter pad. In the arrangement shown, the bottom of perimeter pad 14 is preferably glued or otherwise adhered to the top surface of support plate 18. Alternatively, the edge portions of support plate 18 may be embedded in a groove provided along the internal wall of perimeter pad 14. Cover 12 includes a base portion 12A and a top portion 12B that are sewn or attached to one another after the internal parts of mattress 10 have been arranged within base portion 12A. External handles 17 are provided on one or both longitudinal sides of mattress 10, and are attached to support plate 18, or possibly to cover 12. Cover 12 is made of conventional quilted mattress cover material, while perimeter pad 14 is preferably formed of foam padding material. The padding layers 16 can be formed of foam padding material, cotton padding material, upholstery material, and/or other materials suitable to provide cushioning properties, and the number of padding layers used is a matter of choice. Support plate 18 is manufactured from plastic, particle board, or other material providing suitable rigidity relative to cover 12, perimeter padding 14, and padding layers 16. As best seen in FIG. 2, support plate 18 includes a plurality of spaced mounting holes 19 each for receiving a spring assembly 20 such that spring assemblies 20 are dispersed throughout the interior of perimeter pad 14.

Figure 5:
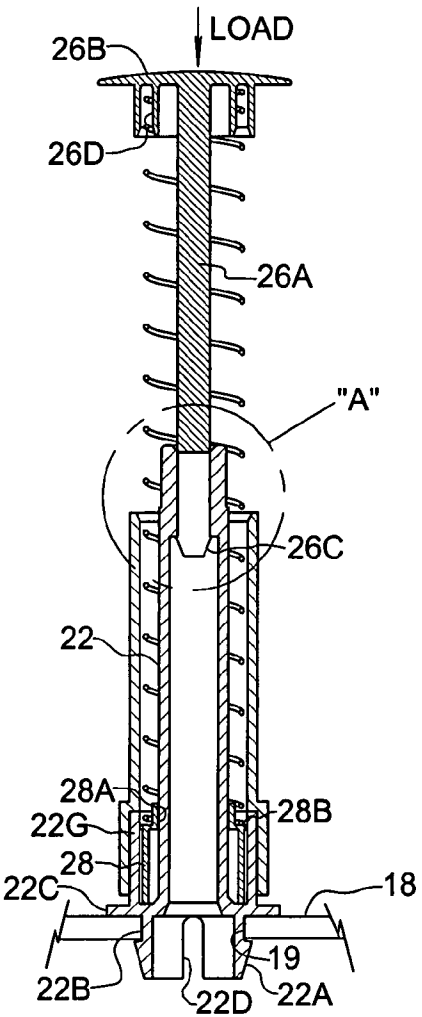
FIG. 5 is a cross-sectional view of the spring assembly shown in FIG. 4.
Figure 6:
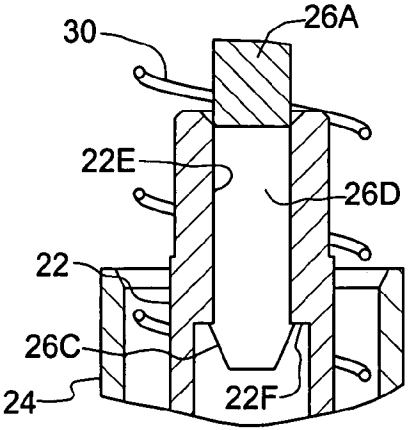
FIG. 6 is an enlarged view of region "A" in FIG. 5.
Figure 4:
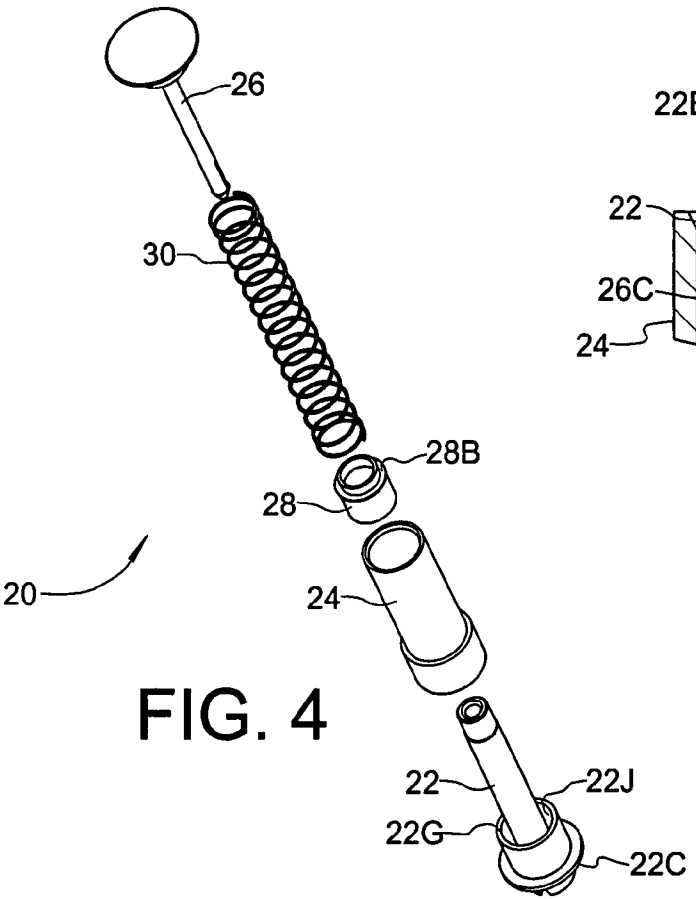
FIG. 4 is an exploded view of a spring assembly formed in accordance with a first embodiment of the present invention.

FIGS. 4–6 show a spring assembly 20 formed in accordance with a first embodiment of the present invention. Spring assembly 20 generally comprises a tubular mounting member 22 fixed to the support plate 18, a sliding cap 26 axially movable relative to mounting member 22, and a spring 30 acting between mounting member 22 and sliding cap 26, wherein spring 30 is axially compressible when sliding cap 26 is forced in an axial direction toward support plate 18.

Mounting member 22 includes a tapered catch plug 22A at a lower end thereof, a neck 22B adjacent to catch plug 22A, and a stabilizing flange 22C adjacent to neck 22B. Catch plug 22A is provided with at least one slot 22D enabling elastic compression of the catch plug so it can pass through mounting hole 19. Neck 22B has an outer diameter that corresponds to the diameter of mounting hole 19 and an axial length that corresponds to the thickness of support plate 18. As will be appreciated, the lower end of mounting member 22 is configured for snap-fitted attachment to support plate 18 by downward insertion of catch plug 22A into mounting hole 19, with stabilizing flange 22C resting flush against a top surface of support plate 18. Mounting member 22 can be removed from attachment to support plate 18 by compressing catch plug 22A and forcing the catch plug upward through mounting hole 19.

Mounting member 22 further includes an axial hole 22E having an annular step 22F located near an upper end of the mounting member, and an outer tubular shell 22G extending upwardly from flange 22C and spaced from a main outer wall of mounting member 22 to define an annular groove 22J.

Sliding cap 26 includes an elongated cylindrical shaft 26A, a radially enlarged head 26B at an upper end of shaft 26A, and a tapered catch member 26C at a lower end of shaft 26A. Shaft 26A is slidably received within and guided by axial hole 22E opening through the upper end of mounting member 22. Tapered catch member 26C, and the provision of a slot 26D therethrough, allow the catch member 26C and shaft 26A to be inserted downwardly into axial hole 22E until the catch member passes annular step 22F in the axial hole, whereby the sliding cap 26 is prevented from being withdrawn upwardly from axial hole 22E by engagement of catch member 26C with annular step 22F. An annular groove 26D is formed on the underside of head 26B.

Spring assembly 20 preferably includes a spacer 28 accommodated by groove 22J of mounting member 22, and a cover sleeve 24 fitting over tubular shell 22G of the mounting member. Spacer 28 includes an axial hole 28A sized to slidably fit over the main outer wall of mounting member 22, and an upwardly-facing outer circumferential step 28B. As can be understood from the drawing figures, an upper end of spring 30 is received by annular groove 26D of sliding cap 26 and bears against the underside of enlarged head 26B, while a lower end of spring 30 bears against circumferential step 28B of spacer 28. Consequently, the preload applied to spring 30 is determined by the axial length of spacer 28, thereby allowing mattress firmness to be easily varied from one location of the mattress to another by provision of spacers 28 having different lengths, or by providing spacers in less than all of the spring assemblies, without the need to provide springs having different properties. Moreover, spacer 28 reduces the length of spring 30, which helps improve stability. A lower segment of spring 30 is confined against buckling by cover sleeve 24.

For purposes of this specification and all embodiments described herein, a spring is deemed to act between two elements even if the ends of the spring do not physically touch the elements, for example where one or more intervening elements are present. This situation is seen in the first embodiment where spacer 28 is intervening structure between the mounting member 22 and a lower end of spring 30. Here, spring 30 is considered to act between mounting member 22 and sliding cap 26 regardless of the presence of spacer 28. It is also conceivable to arrange spacer 28 in sliding cap 26. Here again, spring 30 is considered to act between the mounting member and the sliding cap 26.

Mounting member 22, cover sleeve 24, sliding cap 26, and spacer 28 are preferably lightweight plastic parts formed by injection molding, however the invention is not limited by the selection of material or manner of manufacture.

The configuration described above for enabling mounting member 22 to be attached to support plate 18 by snap-fit is of course subject to a variety of design alterations to achieve the same effect of a snap fit. By way of non-limiting example, mounting holes 19 could be formed with a pair of diametrically opposite keyways for receiving a pair of corresponding protrusions formed on a bottom portion of mounting member 22, such that the bottom portion of mounting member 22 could be inserted through the mounting hole and then rotated by to lock the mounting member in place. As another alternative, mounting members 22 could fixed to support plate 18 by adhesive or fasteners.

In accordance with the above description, each spring assembly 20 is individually mounted to support plate 18 and is independent of the other spring assemblies in the sense that its orientation and action are unaffected by removal or compression of another spring assembly of the mattress.

Figure 8:
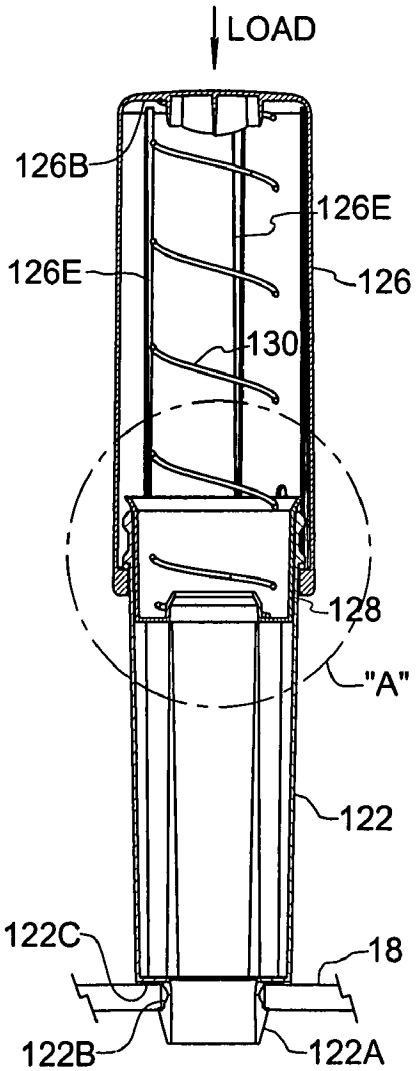
FIG. 8 is a cross-sectional view of the spring assembly shown in FIG. 7.
Figure 9:
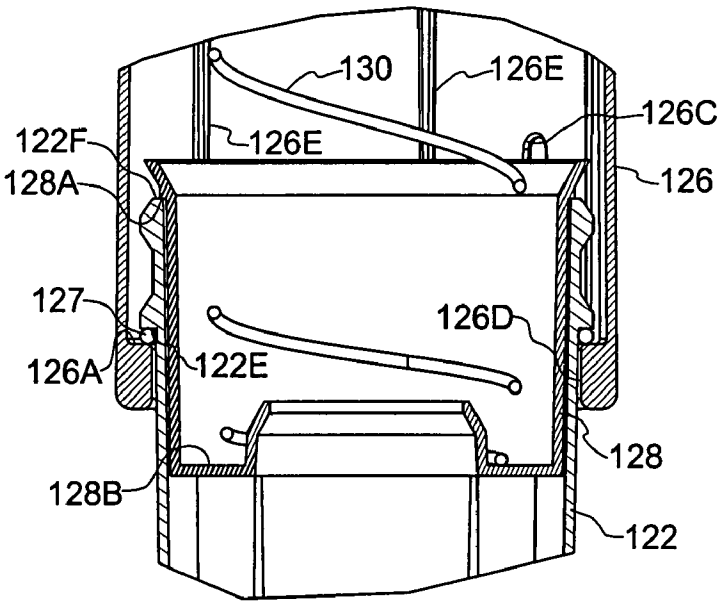
FIG. 9 is an enlarged view of region "A" in FIG. 8.
Figure 7:
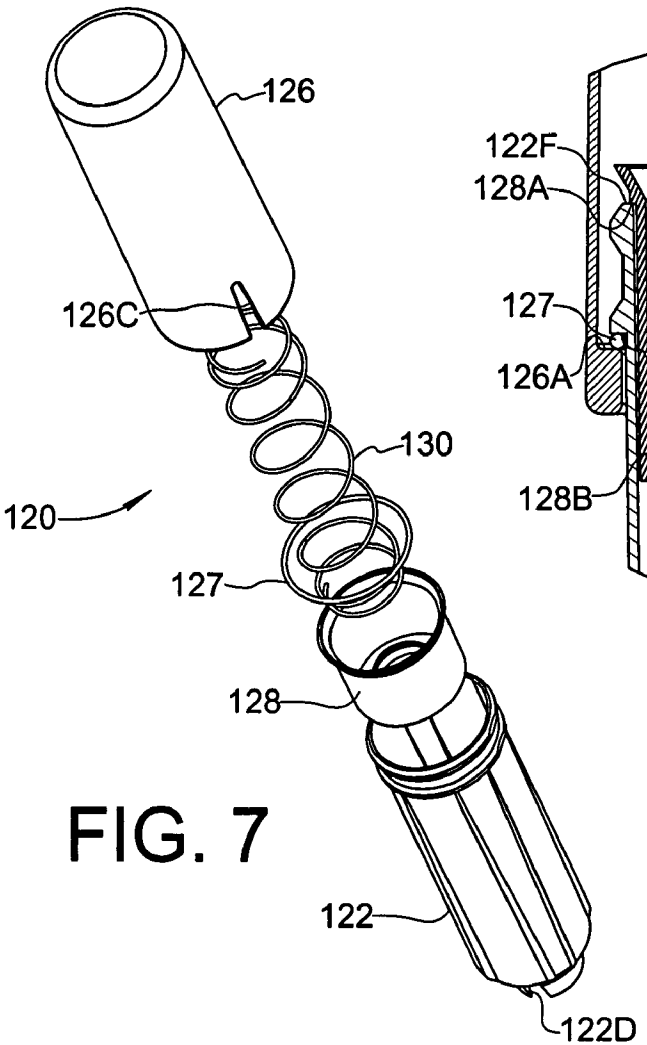
FIG. 7 is an exploded view of a spring assembly formed in accordance with a second embodiment of the present invention.

FIGS. 7–9 show a spring assembly 120 formed in accordance with a second embodiment of the present invention as an alternative to spring assembly 20 of the first embodiment. Spring assembly 120 generally comprises a tubular mounting member 122 fixed to the support plate 18, a sliding cap 126 axially movable relative to mounting member 122, and a spring 130 acting between mounting member 122 and sliding cap 126, wherein spring 130 is axially compressible when sliding cap 126 is forced in an axial direction toward support plate 18.

Mounting member 122 includes a tapered catch plug 122A at a lower end thereof, a neck 122B adjacent to catch plug 122A, and a stabilizing surface 122C adjacent to neck 122B. Catch plug 122A is provided with slots 122D enabling elastic compression of the catch plug so it can pass through mounting hole 19. Neck 122B has an outer diameter that corresponds to the diameter of mounting hole 19 and an axial length that corresponds to the thickness of support plate 18. The lower end of mounting member 122 is thus configured for snap-fitted attachment to support plate 18 by downward insertion of catch plug 122A into mounting hole 19, with stabilizing surface 122C resting flush against a top surface of support plate 18. Mounting member 122 can be removed from attachment to support plate 18 by compressing catch plug 122A and forcing the catch plug upward through mounting hole 19.

At an upper end of mounting member 122, there is provided an external shoulder surface 122E facing downward and a top surface 122F facing upward.

Sliding cap 126 of the second embodiment is a tubular member that includes an open lower end having an internal shoulder surface 126A facing upwardly in opposition to downwardly facing shoulder surface 122E of mounting member 122, and a closed upper end configured to provide an internal annular groove 126B. A slot 126C is provided through the wall of sliding cap 126 to facilitate elastic expansion of the lower end during assembly of spring assembly 120. Sliding cap 126 is telescopically adjustable in an axial direction relative to mounting member 122 and is guided by sliding engagement of internal surface 126D with the outer wall surface of mounting member 122. An o-ring or foam ring 127 is preferably seated circumferentially about mounting member 122 adjacent shoulder surface 122E, such that upwardly directed withdrawal of sliding cap 126 is prevented by engagement of shoulder surface 126A with o-ring 127 as shown in FIG. 9. A plurality of internal axially extending rails 126E provide support about spring 130 to prevent buckling of the spring.

Spring assembly 120 preferably includes a spacer 128 having a lip 128A in abutment with top surface 122F of mounting member 122 such that spacer 128 is seated at the upper end of mounting member 122. Spacer 128 includes an annular groove 128B opposite annular groove 126B of sliding cap 126. As can be understood from the drawing figures, an upper end of spring 130 is received by annular groove 126B to bear against sliding cap 126, while a lower end of spring 130 bears against annular groove 128B of spacer 128. Thus, the preload applied to spring 130 is determined by the axial depth of spacer 128, thereby allowing mattress firmness to be easily varied from one location of the mattress to another by provision of spacers 128 having different depths, without the need to provide springs having different properties. Moreover, spacer 128 reduces the length of spring 130, thereby improving stability.

Figure 10:
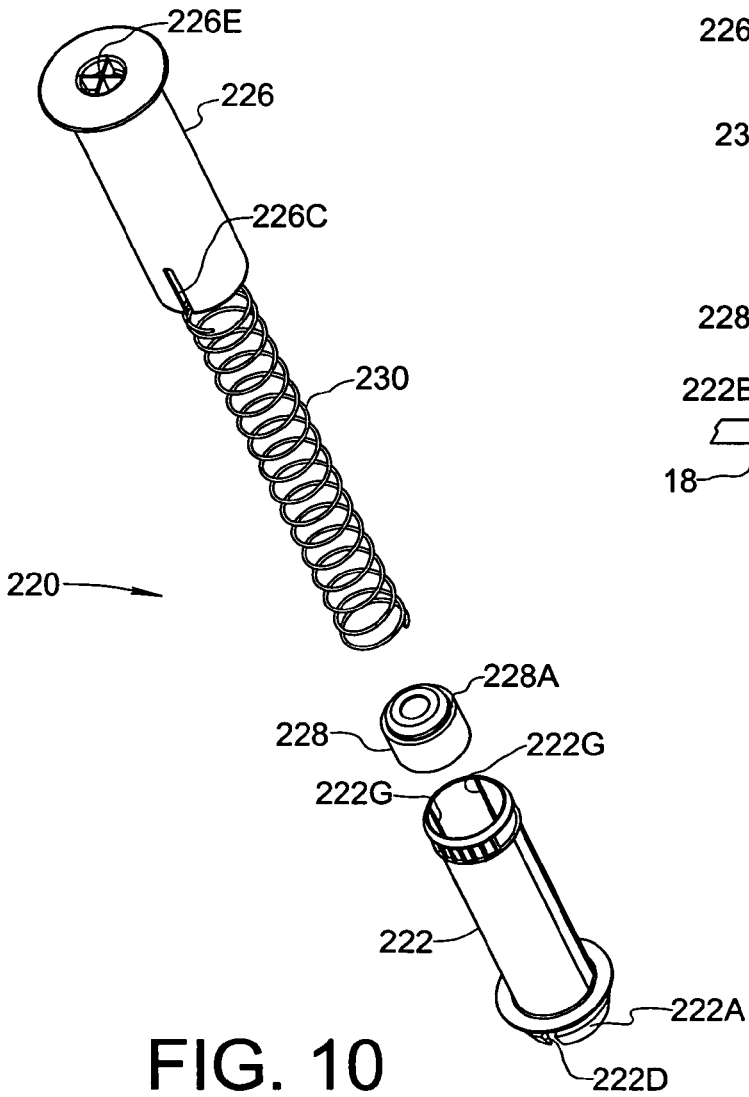
FIG. 10 is an exploded view of a spring assembly formed in accordance with a third embodiment of the present invention.
Figure 11:
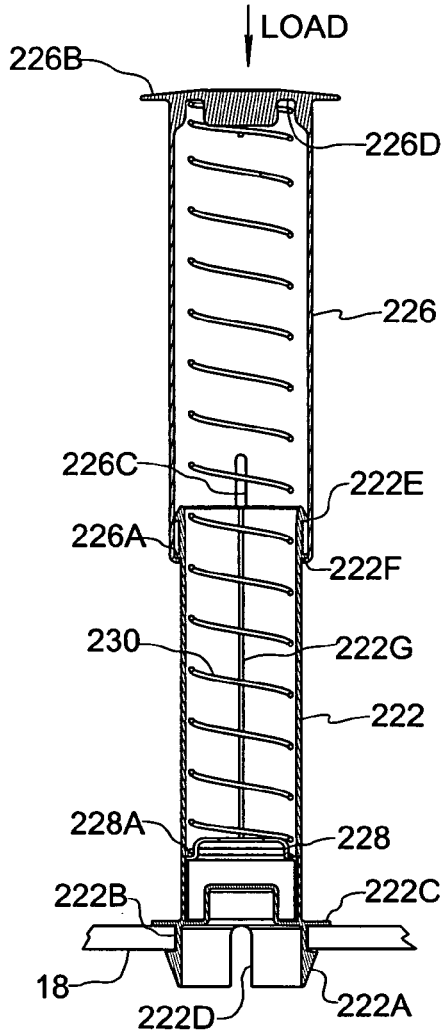
FIG. 11 is a cross-sectional view of the spring assembly shown in FIG. 10.

FIGS. 10 and 11 depict a spring assembly 220 formed in accordance with a third embodiment of the present invention as having a tubular mounting member 222 fixed to the support plate 18, a sliding cap 226 axially movable relative to mounting member 222 in telescoping fashion, and a spring 230 acting between mounting member 222 and sliding cap 226, wherein spring 230 is axially compressible when sliding cap 226 is forced in an axial direction toward support plate 18.

Mounting member 222 is generally similar to mounting member 22 of the first embodiment and includes a tapered catch plug 222A at a lower end thereof, a neck 222B adjacent to catch plug 222A, and a stabilizing flange 222C adjacent to neck 222B. Catch plug 222A is provided with a slot 222D enabling elastic compression of the catch plug so it can pass through mounting hole 19. Neck 222B has an outer diameter that corresponds to the diameter of mounting hole 19 and an axial length that corresponds to the thickness of support plate 18. Thus, the lower end of mounting member 222 is configured for snap-fitted attachment to support plate 18 by downward insertion of catch plug 222A into mounting hole 19, with stabilizing flange 222C resting flush against a top surface of support plate 18. Mounting member 222 can be removed from attachment to support plate 18 by compressing catch plug 222A and forcing the catch plug upward through mounting hole 19.

Mounting member 222 further includes a guide shoulder 222E at its upper end for engaging an inner wall of sliding cap 226, a circumferential external rib 222F axially spaced from guide shoulder 222E but generally near the guide shoulder, and a plurality of internal axially extending rails 222G.

In the third embodiment, sliding cap 226 is a tubular member that includes an open lower end having an internal shoulder 226A defining an upwardly facing surface in opposition to a downwardly facing surface of external rib 222F, and a closed upper end characterized by a radially enlarged head 226B configured to provide an internal annular groove 226D. At least one slot 226C is provided through the wall of sliding cap 226 to facilitate elastic expansion of the lower end during assembly of spring assembly 220. Sliding cap 226 is telescopically adjustable in an axial direction relative to mounting member 222 and is guided by sliding engagement of internal shoulder 226A with an outer wall surface of mounting member 222, as well as by sliding engagement of guide shoulder 222E and rib 222F with an inner wall surface of sliding cap 226. Upwardly directed withdrawal of sliding cap 226 is prevented by engagement of shoulder 226A with rib 222F, as seen in FIG. 11. A vent 226E is provided through head 226B to allow air flow during compression and expansion of the spring assembly.

Spring assembly 220 preferably includes a spacer 228 having a lower end in abutment with an internal radial extension of flange 222C. Spacer 228 includes an upwardly-facing outer circumferential step 228A. As can be understood from FIG. 11, an upper end of spring 230 is received by annular groove 226D of sliding cap 226 and bears against the underside of enlarged head 226B, while a lower end of spring 230 bears against circumferential step 228A of spacer 228, whereby the preload applied to spring 230 is determined by the axial length of spacer 228. Rails 222G provide support about spring 230 to prevent buckling of the spring.

Figure 13:
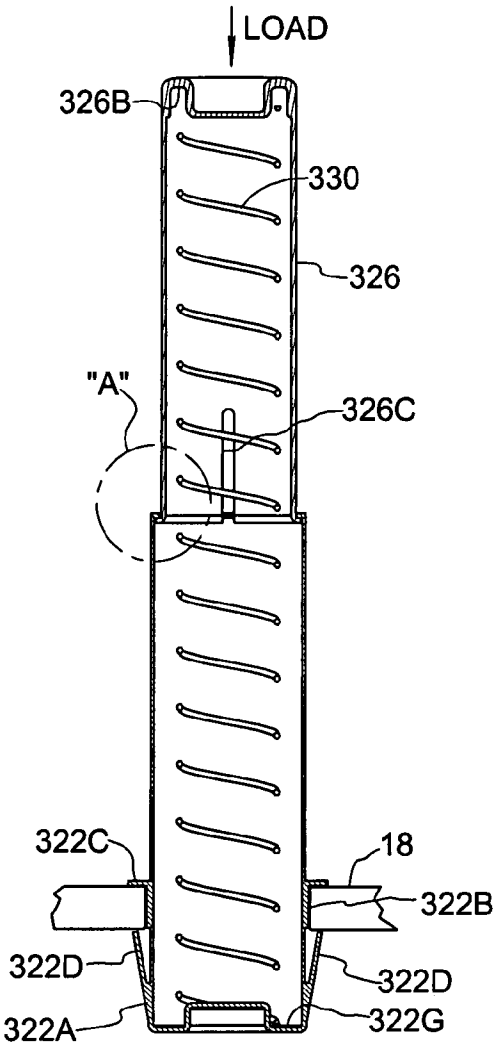
FIG. 13 is a cross-sectional view of the spring assembly shown in FIG. 12.
Figure 14:
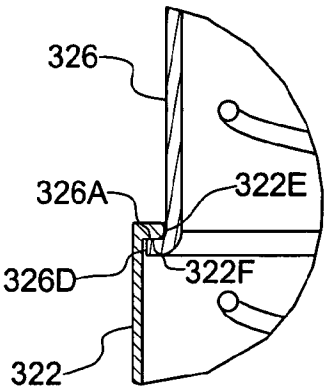
FIG. 14 is an enlarged view of region "A" in FIG. 13.
Figure 12:
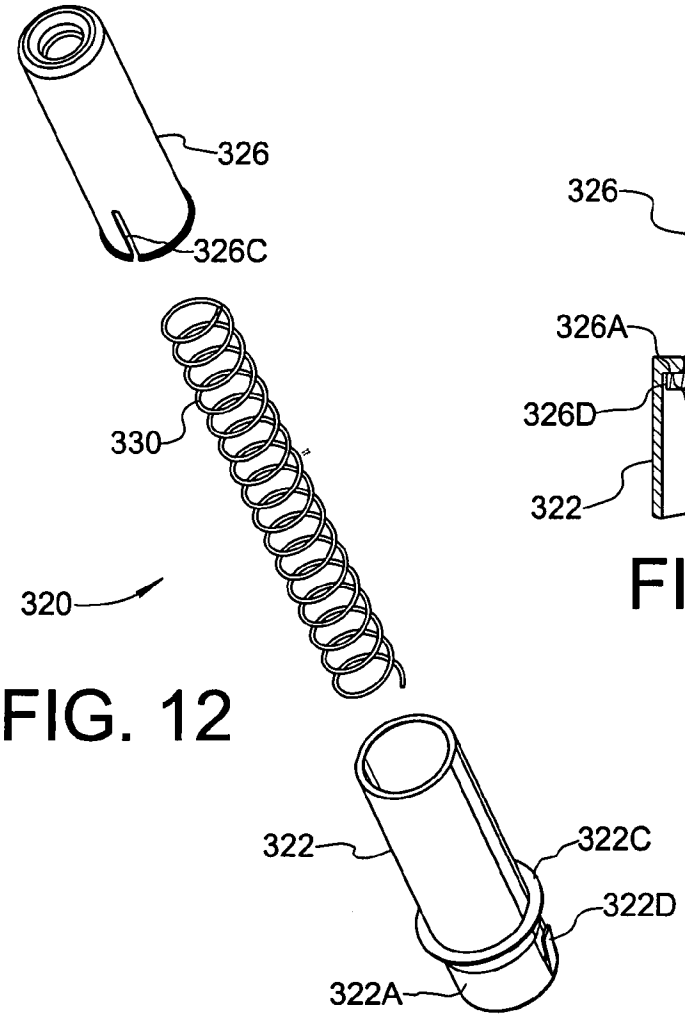
FIG. 12 is an exploded view of a spring assembly formed in accordance with a fourth embodiment of the present invention.

A spring assembly 320 formed in accordance with a fourth embodiment of the present invention is illustrated by FIGS. 12–14. Spring assembly 320 includes a tubular mounting member 322 fixed to the support plate 18, a sliding cap 326 axially movable relative to mounting member 322 in telescoping fashion, and a spring 330 acting between mounting member 322 and sliding cap 326. As can be understood from the FIG. 13, spring 330 is axially compressible when sliding cap 326 is forced in an axial direction toward support plate 18.

Mounting member 322 includes a catch plug 322A at a lower end thereof having a plurality of radially flexible catch members 322D, a neck 322B adjacent to catch plug 322A, and a stabilizing flange 322C adjacent to neck 322B. Catch members 322D flex radially inward to enable catch plug 322A to pass through mounting hole 19. Neck 322B has an outer diameter that corresponds to the diameter of mounting hole 19 and an axial length that corresponds to the thickness of support plate 18. In this way, the lower end of mounting member 322 is configured for snap-fitted attachment to support plate 18 by downward insertion of catch plug 322A into mounting hole 19 until stabilizing flange 322C rests flush against the top surface of support plate 18. Mounting member 322 can be removed from attachment to support plate 18 by compressing catch members 322D and forcing the catch plug 322A upward through mounting hole 19.

Mounting member 322 further includes an inward guide shoulder 322E at its upper end for engaging an outer wall of sliding cap 326, and a downwardly facing annular stop surface 322F defined by the guide shoulder, and an upwardly facing annular groove 322G at the lower end of the mounting member for receiving a lower end of spring 330.

Sliding cap 326 of the fourth embodiment is a tubular member that includes an open lower end having an outward shoulder 326D defining an upwardly facing surface 326A in opposition to downwardly facing stop surface 322F, and a closed upper end having an internal annular groove 326B for receiving an upper end of spring 330. A slot 326C is provided through the wall of sliding cap 326 to facilitate elastic expansion of the lower end during assembly of spring assembly 320. Sliding cap 326 is telescopically adjustable in an axial direction relative to mounting member 322 and is guided by sliding engagement of shoulder 326D with an inner wall surface of mounting member 322, as well as by sliding engagement of guide shoulder 322E with an outer wall surface of sliding cap 326. Upwardly directed withdrawal of sliding cap 326 is prevented by engagement of surface 326A with stop surface 322F, as seen in FIG. 14.

Figure 15:
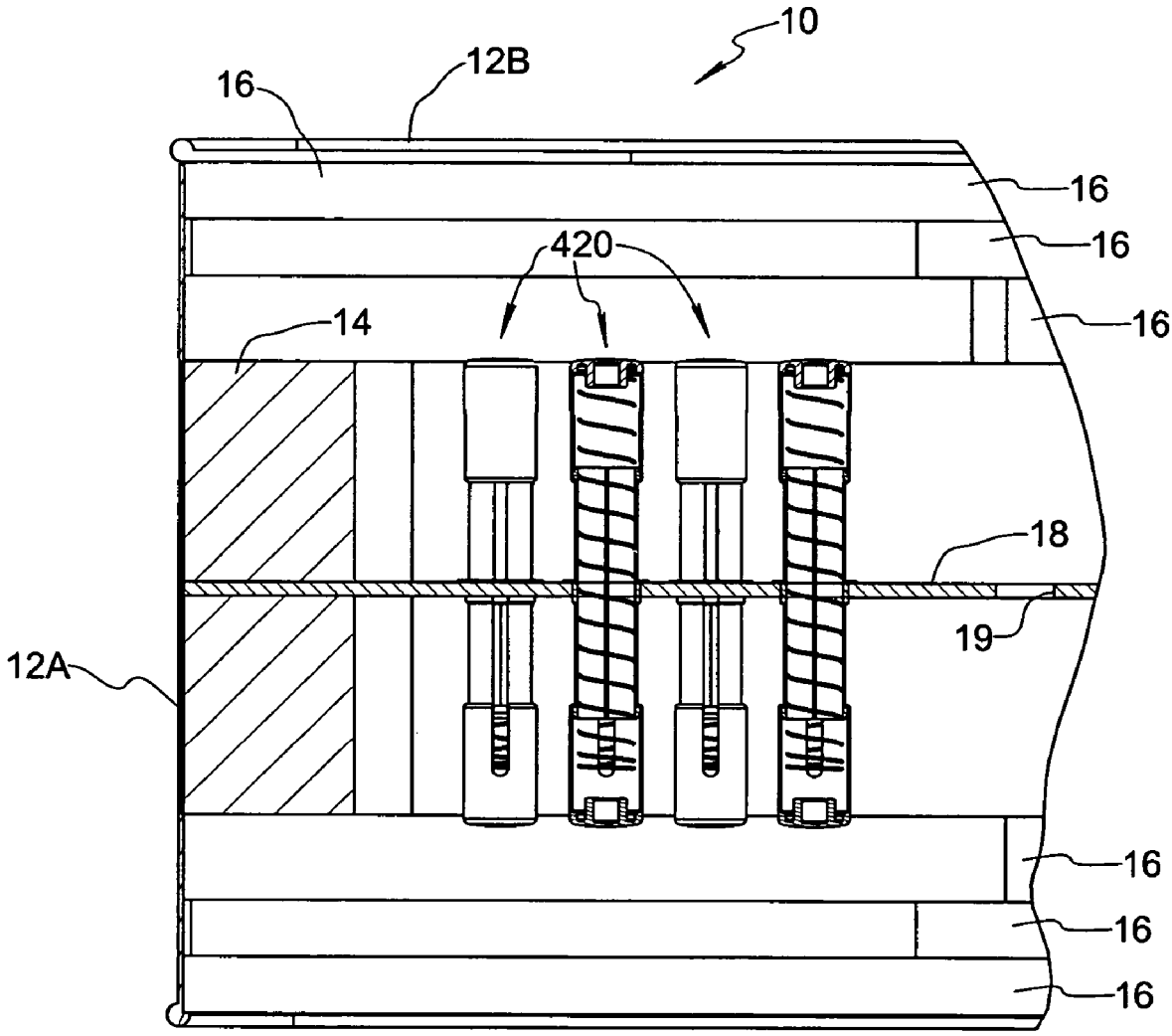
FIG. 15 is a view similar to that of FIG. 3, however the mattress comprises spring assemblies formed in accordance with a fifth embodiment of the present invention.
Figure 17:
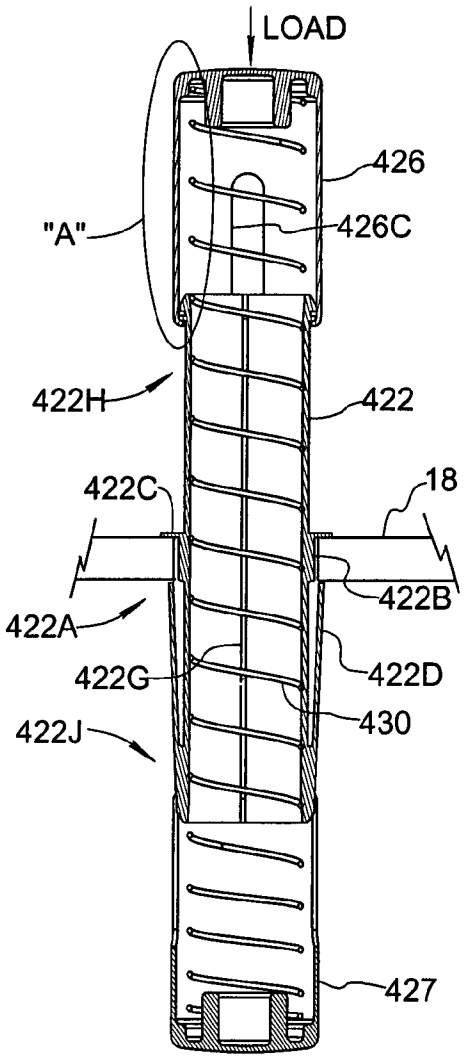
FIG. 17 is a cross-sectional view of the spring assembly shown in FIGS. 15 and 16.

A fifth embodiment of the present invention is the subject of FIGS. 15–18, and differs from the previously described embodiments because a spring assembly 420 of the fifth embodiment includes sliding caps above and below the support plate to provide a "flippable" mattress having the same performance properties regardless of which side of the mattress faces up. As can be seen in FIG. 15, the support plate 18 is now situated midway between top and bottom sets of padding layers 16. Spring assembly 420 includes a tubular mounting member 422, an upper sliding cap 426 axially movable relative to mounting member 422 in telescoping fashion, a lower sliding cap 427 also axially movable relative to mounting member 422 in telescoping fashion, and a spring 430 acting between the upper sliding cap and the lower sliding cap, wherein the spring is axially compressible when the upper and lower sliding caps are forced in an axial direction toward the support plate.

Mounting member 422 generally includes an upper portion 422H, a lower portion 422J, and a mid-portion 422A between the upper and lower portions. Mid-portion 422A has a plurality of radially flexible catch members 422D, a neck 422B above and adjacent to catch members 422D, and a stabilizing flange 422C above and adjacent to neck 422B. Catch members 422D flex radially inward to pass through mounting hole 19. Neck 422B has an outer diameter that corresponds to the diameter of mounting hole 19 and an axial length that corresponds to the thickness of support plate 18. In this way, mid-portion 422A of mounting member 422 is configured for snap-fitted attachment to support plate 18 by downward insertion of lower portion 422J through mounting hole 19 until stabilizing flange 422C rests flush against the top surface of support plate 18. Mounting member 422 can be removed from attachment to support plate 18 by compressing catch members 422D and forcing lower portion 422J upward through mounting hole 19.

A plurality of internal, axially extending rails 422G extend substantially the length of tubular mounting member 422 for maintaining axial alignment of spring 430.

Figure 18:
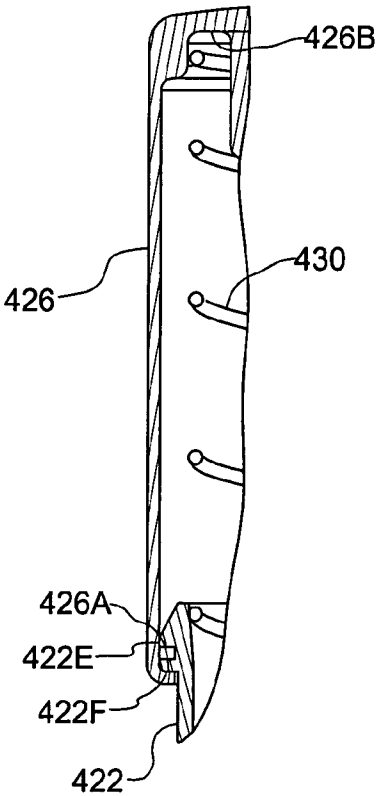
FIG. 18 is an enlarged view of region "A" in FIG. 17.
Figure 16:
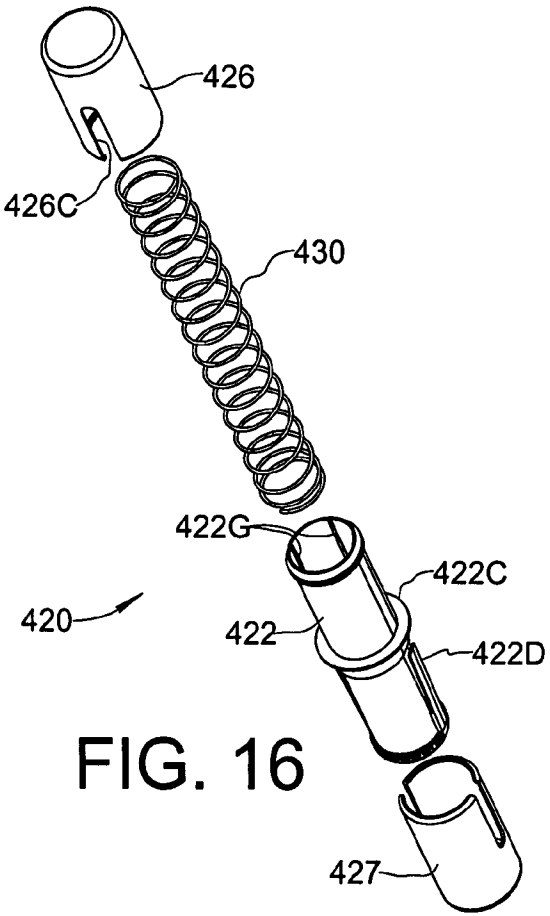
FIG. 16 is an exploded view of the spring assembly shown in FIG. 15.

Upper portion 422H of mounting member 422 will now be described with reference to FIG. 18, it being understood that similar but opposite structure is provided on lower portion 422J. A guide shoulder 422E is provided near the terminal end of upper portion 422H for engaging an inner wall of upper sliding cap 426, and a circumferential external rib 422F is axially spaced from guide shoulder 422E but generally near the guide shoulder.

Upper sliding cap 426 will now be described. Sliding cap 426 is a tubular member that includes an open lower end having an internal shoulder 426A defining an upwardly facing surface in opposition to a downwardly facing surface of external rib 422F, and a closed upper end configured to provide an internal annular groove 426B. At least one slot 426C is provided through the wall of sliding cap 426 to facilitate elastic expansion of the lower end during assembly of spring assembly 420. Sliding cap 426 is telescopically adjustable in an axial direction relative to upper portion 422H of mounting member 422 and is guided by sliding engagement of internal shoulder 426A with an outer wall surface of mounting member 422, as well as by sliding engagement of guide shoulder 422E and rib 422F with an inner wall surface of sliding cap 426. Upwardly directed withdrawal of sliding cap 426 is prevented by engagement of shoulder 426A with rib 422F, as seen in FIG. 18.

Lower sliding cap 427 is configured the same as upper sliding cap 426, but is orientated in opposite mirror-image fashion, so as to be telescopically adjustable in an axial direction relative to lower portion 422J of mounting member 422.

Figure 19:
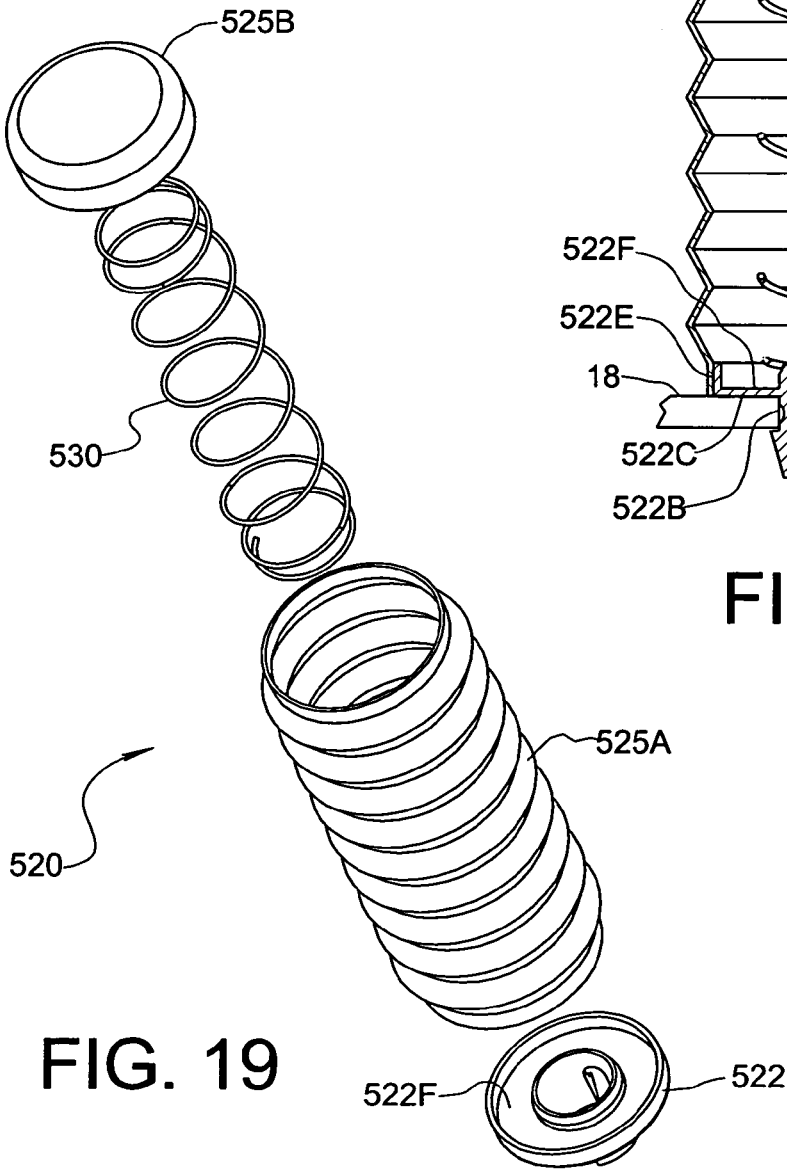
FIG. 19 is an exploded view of a spring assembly formed in accordance with a sixth embodiment of the present invention.
Figure 20:
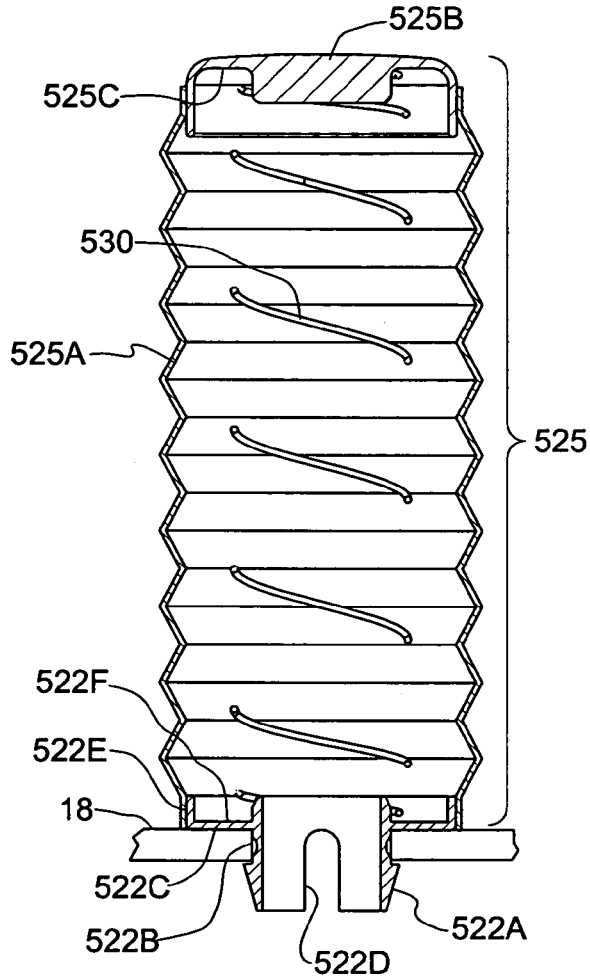
FIG. 20 is a cross-sectional view of the spring assembly shown in FIG. 19.

A spring assembly 520 formed in accordance with a sixth embodiment of the present invention is shown in FIGS. 19 and 20. Spring assembly 520 includes a mounting member 522, a bellows 525 having a first end fixed to the mounting member 522 and a second end axially movable relative to the mounting member, and a spring 530 acting between the mounting member and the bellows, wherein the spring is axially compressible when the second end of the bellows is forced in an axial direction toward the support plate 18. Spring assembly 520 offers a quieter alternative to the spring assemblies disclosed previously herein.

Mounting member 522 of the sixth embodiment is preferably configured for snap-fit attachment to support plate 18 by insertion of a catch plug 522A through a mounting hole 19 in the support plate. By way of example, mounting member 522 includes a neck 522B adjacent to catch plug 522A, a stabilizing flange 522C adjacent to neck 522B, a stem portion 522E extending vertically from flange 522C, and an upwardly facing annular groove 522F. Catch plug 522A is provided with at least one slot 522D enabling elastic compression of the catch plug so it can pass through mounting hole 19. Neck 522B has an outer diameter that corresponds to the diameter of mounting hole 19 and an axial length that corresponds to the thickness of support plate 18. Thus mounting member 522 is configured for snap-fitted attachment to support plate 18 by downward insertion of catch plug 522A into mounting hole 19, with stabilizing flange 522C resting flush against a top surface of support plate 18. Mounting member 522 can be removed from attachment to support plate 18 by compressing catch plug 522A and forcing the catch plug upward through mounting hole 19.

Bellows 525 generally includes a collapsible portion 525A and a cap 525B. A first end of collapsible portion 525A is fixed to stem portion 522E of mounting member 522, and a second end of collapsible portion 525A is fixed to cap 525B. As can be understood from FIG. 20, the second end of collapsible portion 525 to which cap 525B is fixed is axially movable relative to mounting member 522. Spring 530 is shown as having one end engaging an annular groove 525C formed in the underside of cap 525B and another end engaging annular grove 522F of mounting member 522, however at least one spacer (not shown) may be inserted between the spring and the cap or between the spring and the mounting member to govern preloading of spring 530.

Mounting member 522 and cap 525B are preferably formed of plastic by injection molding, however other suitable materials and manufacturing techniques may be used. Collapsible portion 525A of bellows 525 can be formed of fabric or other suitable material that will readily and quietly collapse when cap 525B is forced toward mounting member 522. The ends of collapsible portion 525A can be glued, stapled, riveted, or otherwise fastened to mounting member 522 and cap 525B. It is also possible to form bellows 525 as a unitary (one-piece) element.

As will be appreciated from the foregoing description, the various embodiments of the present invention provide a mattress construction that is easy to manufacture because it involves a low number of mass-producible parts that may be quickly and simply assembled. Moreover, the mattress embodiments described and claimed herein provide independent spring support, a feature long recognized as desirable in a mattress. As a further benefit, the spring properties associated with each independent spring assembly are easily set using a suitable spacer or spring to provide desired support performance at specific locations over the mattress, thereby allowing customized mattress construction.

What is claimed is:

1. A mattress comprising:

a support plate;

a plurality non-fluidic of spring assemblies individually mounted to the support plate, each of the plurality of spring assemblies including a tubular mounting member fixed to the support plate, a sliding cap axially movable relative to the mounting member, a non-fluidic spring acting between the mounting member and the sliding cap, and a spacer slidably received and supported by the mounting member and engaged by an end of the spring, wherein the spring is axially compressible when the sliding cap is forced in an axial direction toward the support plate; and a cover enclosing the support plate and the plurality of spring assemblies.

2. The mattress according to claim 1, wherein the support plate includes a plurality of mounting holes through the support plate for receiving the mounting member of an associated spring assembly.

3. The mattress according to claim 2, wherein the mounting member is configured for snap-fit attachment to the support plate.

4. The mattress according to claim 3, wherein the mounting member is removable from its snap-fit attachment to the support plate.

5. The mattress according to claim 1, wherein the sliding cap is a tubular member telescopically connected to the mounting member.

6. The mattress according to claim 1, wherein the sliding cap includes a plunger rod slidably received by the mounting member.

7. The mattress according to claim 1, wherein the sliding cap includes a radially enlarged head.

8. The mattress according to claim 1, wherein the spacer of at least one of the plurality of spring assemblies has a different axial length than the spacer of another one of the plurality of spring assemblies.

9. The mattress according to claim 1, wherein the mounting member and the sliding cap are formed of plastic by injection molding.

10. The mattress according to claim 1, wherein the mounting member, the sliding cap, and the spacer are formed of plastic by injection molding.

11. A mattress comprising:

a support plate;

a plurality of spring assemblies individually mounted to the support plate, each of the plurality of spring assemblies including a tubular mounting member fixed to the support plate, a sliding cap axially movable relative to the mounting member, and a spring acting between the mounting member and the sliding cap, wherein the spring is axially compressible when the sliding cap is forced in an axial direction toward the support plate; and a cover enclosing the support plate and the plurality of spring assemblies, wherein at least one but not all of the plurality of spring assemblies further includes a spacer engaged by an end of the spring.

* * * * *

UNITED STATES PATENT AND TRADEMARK OFFICE

CERTIFICATE OF CORRECTION

PATENT NO. : 6,996,865 B2
APPLICATION NO. : 10/850606
DATED : February 14, 2006
INVENTOR(S) : Jeffrey M. Sabin It is certified that error appears in the above-identified patent and that said Letters Patent is hereby corrected as shown below:

On Title Page, item (60) "Related U.S. Application Data" recites "Provisional application No. 60/472,936" in error and should recite:
--Provisional application No. 60/472,926--

Col. 1, line 7 recites "Application No. 60/472,936" in error and should recite:
--Application No. 60/472,926--

Signed and Sealed this

Thirty-first Day of July, 2007

JON W. DUDAS
*Director of the United States Patent and Trademark Office*